United States Patent [19]

Newton

[11] 4,208,606

[45] Jun. 17, 1980

[54] FILAMENT-SUPPORT MEANS FOR A TUBULAR INCANDESCENT LAMP

[75] Inventor: Ralph E. Newton, Dover, N.J.

[73] Assignee: Westinghouse Electric Corp., Pittsburgh, Pa.

[21] Appl. No.: 2,286

[22] Filed: Jan. 10, 1979

[51] Int. Cl.[2] ..... H01K 1/24

[52] U.S. Cl. ..... 313/274; 313/279

[58] Field of Search ..... 313/274, 279

[56] References Cited

U.S. PATENT DOCUMENTS

| | | | |
|---|---|---|---|
| 3,173,051 | 3/1965 | Berlinghof et al. | 313/274 |
| 3,270,238 | 8/1966 | Mosby | 313/279 |
| 3,335,312 | 8/1967 | Cardwell, Jr. | 313/279 |
| 3,390,299 | 6/1968 | Van Sickler et al. | 313/274 |
| 3,521,112 | 7/1970 | Walsh et al. | 313/274 |
| 3,736,455 | 5/1973 | Notelteirs et al. | 313/274 |
| 3,784,865 | 1/1974 | Shanks | 313/274 |

*Primary Examiner*—Alfred E. Smith
*Assistant Examiner*—Charles F. Roberts
*Attorney, Agent, or Firm*—D. S. Buleza

[57] ABSTRACT

The coiled-coil filament of a tubular incandescent lamp is held in suspended longitudinally-extending position within the envelope by lead-in conductors and a single support wire that is anchored in one of the envelope seals and has a hook portion that is coupled to one of the secondary turns of the filament. The free end of the filament-support member is formed into a single loop that nestingly engages the arcuate wall of the envelope and thus holds the support member and filament in the desired position during the sealing-in operation and within the finished lamp. The unique shape of the support member simplifies its manufacture and its subsequent assembly with the coiled filament and envelope. When the coiled filament is long and very flexible, proper positioning of the filament-support assembly within the tubular envelope prior to and during the sealing-in operation is ensured by providing the wire support with a finger-like extension of such configuration that it effects a slip-fit interlock with the exhaust tube that is fused to the side wall of the envelope but prevents the extension from being embedded therein when the tube is subsequently tipped-off, thus eliminating a potential air-leakage path into the sealed lamp.

9 Claims, 5 Drawing Figures

FILAMENT-SUPPORT MEANS FOR A TUBULAR INCANDESCENT LAMP

BACKGROUND OF THE INVENTION

1. Field of the Invention:

This invention relates to electric lamps and has particular reference to an improved filament-support means for tubular incandescent lamps that have elongated coiled filaments. 2. Description of the Prior Art:

Incandescent lamps having helically-coiled filaments that are held in suspended position within a tubular envelope by various kinds of support members are generally well known in the art.

A tubular lamp of this type having a filament-support member made from wire that is bent to form two circular loops which engage the arcuate side walls of the envelope and are joined by a medial segment that includes a scissors-like clamp that is coupled to a secondary turn of the coiled-coil filament is disclosed in U.S. Pat. No. 3,173,051, granted Mar. 9, 1965 to Berlinghof et al. One of the loops may be provided with a crimp or fold that engages the exhaust tip cavity and thus retains the wire support in place within the envelope (FIG. 3 embodiment).

Single-ended and double-ended incandescent lamps having tubular envelopes with a U-shaped wire support that has both of its legs anchored in the envelope seal and its bent end formed into a loop that encircles the coiled filament is disclosed in U.S. Pat. No. 3,270,238, issued Aug. 30, 1966 to Mosby. A filament-support member for a tubular incandescent lamp formed from a straight piece of wire that extends along the inner surface of the envelope, has both ends embedded in the press seals formed at each end of the envelope and which includes a centrally-located loop or hook that is coupled to a secondary turn of the coiled-coil filament is disclosed in U.S. Pat. No. 3,335,312, granted Aug. 8, 1967 to Cardwell, Jr. A similar support member for a coiled-coil filament is disclosed in U.S. Pat. No. 3,390,299 (issued June 25, 1968 to VanSickler et al.) and consists of a wire member having one leg that is anchored in the sealed end of the envelope and is terminated by a loop which is coupled to one of the secondary turns of the filament and has an upstanding leg segment that protrudes into sealed residue of the exhaust tube portion of the envelope. In the FIGS. 8 and 9 embodiments, the upstanding leg segments are formed by retroverted medial segments of the support wires and the coupling-loops are located at the free ends of the respective supports.

In accordance with a more recent proposal, one end of the support wire for the coiled-coil filament of a tubular type lamp is anchored in one of the envelope seals and has a medial segment which is bent into a triangular-shaped loop that loosely encircles the filament barrel and engages the inner surface of the envelope. A support member of this construction is shown in U.S. Pat. No. 3,521,112 (issued July 21, 1970 to Walsh et al.). The patentees also disclose an alternative lamp embodiment (FIG. 7) which employs a wire support member that has a pair of overlapping leg segments and is terminated by a spiral which loosely encircles the barrel portion of the coiled-coil filament and also engages the inner wall of the tubular envelope in such a manner that the axially-extending leg segments of the support are seated against the opposite wall of the envelope, thus eliminating the need for anchoring one or both legs in the envelope seals.

Tubular incandescent lamps having filament-support wires with helically-coiled portions of large and small diameter that engage the envelope walls and the barrel portion of the coiled-coil filament, respectively, are disclosed in U.S. Pat. Nos. 3,736,455 (granted May 29, 1973 to Notelteirs et al.) and 3,784,865 (granted Jan. 8, 1974 to Shanks).

SUMMARY OF THE INVENTION

While the aforementioned filament-support members of the prior art were generally satisfactory from a functional standpoint in that they prevented the central portion of the suspended filament coil from sagging and contacting the bulb, they had serious deficiencies from both a cost and manufacturing standpoint. Due to their complex shape, some were obviously quite expensive to make and difficult to assemble with the filament. Others required both ends of the support wire to be anchored in the envelope seals. This complicated the press-sealing operation since extreme care had to be exercised to ensure that the support remained in the proper position while the seal was being made. It was also found that straight support wires having a medial portion which was merely looped around one of the turns of the coiled-coil filament did not provide adequate support for the central portion of the filament since the support had a tendency to sag downwardly along with the filament during the extended normal life of the lamp, especially when the latter was burned in a horizontal position and/or the lamp was operated under rough service conditions.

All of the foregoing problems and disadvantages are remedied in accordance with the present invention by using a single support member that is of such shape that it not only holds the coiled filament in it suspended position but can be readily manufactured and then assembled with the filament and anchored in place within the finished lamp without complicating the sealing-in operation. This is achieved by making the improved support member from wire that is bent to provide a straight leg portion which is anchored in one of the envelope seals and has its free end terminated by a U-shaped hook and a loop portion of a single turn. The loop portion is disposed in a transverse plane (relative to the filament axis and the leg portion) and is so dimensioned and shaped that it nestingly engages and is interlocked with the arcuate surface of the tubular envelope—thus properly positioning the leg portion for the sealing-in operation. The hook extends around and is coupled to a single secondary turn of the coiled-coil filament and, in conjunction with the stabilizing action provided by the envelope-engaging looped end of the support member, holds the central portion of the filament coil in the desired suspended position within the envelope even though the lamp is continuously burned in a horizontal position.

In lamps having wattage and voltage ratings such that the coiled-coil filament is long and very flexible or "flimsy", auxiliary means for retaining the support member in proper position during the sealing-in operation is provided by forming a finger-like extension adjacent the hook segment that laterally protrudes into and effects a slipfit interlock with the exhaust tube aperture in the side wall of the envelope when the filament-support assembly is inserted into the envelope.

BRIEF DESCRIPTION OF THE DRAWINGS

A better understanding of the invention will be obtained from the exemplary embodiments shown in the accompanying drawing, wherein.

DESCRIPTION OF THE PREFERRED EMBODIMENTS

While the present invention can be advantageously employed in single-ended tubular incandescent lamps that have coiled filaments of such length or shape that they require auxiliary support means, it is especially adapted for use in conjunction with double-ended tubular incandescent lamps that have such filaments and are designed for horizontal burning and the invention has, accordingly, so illustrated and will be so described.

Figure 1:
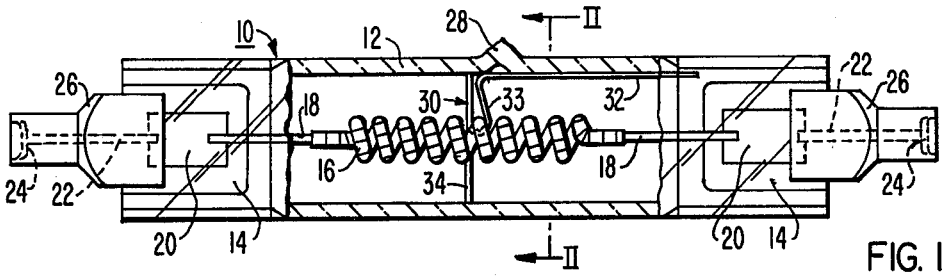
FIG. 1 is an elevational view of a high-wattage double-ended incandescent lamp embodying the invention, a portion of the tubular envelope being removed for illustrative purposes.

A representative incandescent lamp 10 of this type is shown in FIG. 1 and consists of the usual tubular envelope 12 of suitable light-transmitting material that is hermetically sealed at each end by a press seal 14 which is formed in the conventional manner by collapsing and fusing the envelope walls after they have been heated to plastic condition. An elongated helically-coiled filament 16 is coaxially suspended within the envelope 12 and connected to inner lead wires 18 that are embedded in the respective press seals. The filament 16 is desirably of the coiled-coil type with singly-coiled legs that are slipped over and fastened to the inner lead wires 18. Ribbon conductors, such as strips of molybdenum foil 20, are embedded in the press seals 14 and connect the inner lead wires 18 with a pair of outer lead wires 22 that protrude from the respective seals and are fastened to suitable terminals such as metal contact buttons 24. The contact buttons and exposed parts of the outer lead wires at each end of the lamp 10 are protectively enclosed by ceramic sleeves 26 or similar components that are secured to the press seals 14 with suitable cement in accordance with standard lamp-making practice.

The envelope 12 is filled with a suitable inert gas (such as nitrogen, argon, krypton, xenon, or a mixture of two or more of such gases) at a pressure of at least one atmosphere. The lamp 10 may comprise a halogen-cycle type lamp and, in such case, will also contain a small but controlled amount of a suitable halogen, such as iodine or bromine, that can be introduced into the envelope in the well-known manner in the form of a suitable thermally-decomposable compound such as tin tetraiodide or methylene bromide. If the lamp 10 is of the halogen-cycle type, then the tubular envelope 12 is fabricated from quartz, borosilicate glass or other hard glass that principally comprises fused silica so that it will withstand the corrosive halogen atmosphere and high temperatures to which it is subjected when the lamp is operated. The inner lead-in wires 18 are also fabricated from tungsten or other suitable metal that will withstand the halogen atmosphere.

In accordance with the present invention, the central portion of the coiled-coil filament 16 is prevented from sagging during the useful life of the lamp 10 by a support member 30 that is formed from wire composed of a suitable metal such as tungsten or molybdenum. As will be noted in FIG. 3, the support member 30 has a substantially straight leg portion 32 that is terminated by a laterally-extending hook 33 which is formed from a medial segment of the wire and is joined to a loop portion 34 of arcuate shape. The loop portion 34 terminates the support 30 and is disposed in a plane that is transverse to and preferably normal to the plane that contains the leg portion 32.

Figure 2:
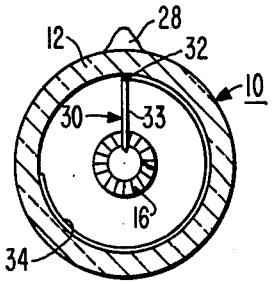
FIG. 2 is a cross-sectional view through the lamp, along line II—II of FIG. 1.
Figure 3:
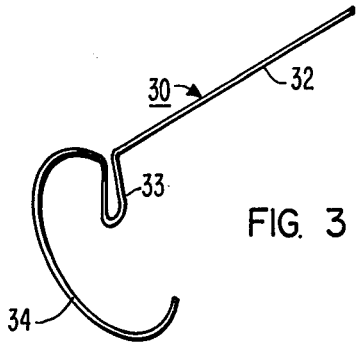
FIG. 3 is a pictorial view of the filament-support member employed in the lamp shown in FIGS. 1 and 2.

As shown in FIGS. 1 and 2, the tip of the leg portion 32 is embedded and thus firmly anchored in one of the press seals 14 at a location near the seal edge so that leg portion 32 extends along the inner wall of the tubular envelope 12 in the same direction as the inner lead wire 18 and helically-coiled filament 16. The leg portion 32 is of such length that the hook 33 extends around and engages a single secondary turn of the coiled-coil filament 16 that is located at approximately the midpoint of the filament. The loop portion 34 is of such size and configuration that it nestingly engages and is seated against the arcuate wall of the tubular envelope 12, thus stabilizing the free inner end of the support wire 30 and holding it in the proper position within the lamp 10. As shown in FIGS. 2 and 3, when the filament-enclosing portion of the tubular envelope 12 is of circular cross-section, the stabilizing arcuate terminal portion 34 of the wire support member 30 is preferably also of circular configuration and consists of only a single turn or a partial turn that extends around at least a major portion of the envelope circumference so that it engages the envelope surface at a sufficient number of points or locations to effect a mechanical interlock with the envelope when the filament-support assembly is inserted into place. Satisfactory results have been obtained by using a circular stabilizing portion 34 that extends around approximately 75% of the envelope circumference, as shown in FIG. 2.

Of course, the diameter of the wire from which the support member 30 is formed is smaller than the spacing between the secondary turns of the coiled-coil filament 16 in order to ensure that the hook segment 33 is spaced from (and thus does not short circuit) the adjacent secondary turns. As a specific example, in the case of a 1,000 watt T-6 type halogen cycle lamp having a tubular envelope approximately 18 millimeters in diameter (outer) and containing a coiled-coil filament having secondary turns approximately six millimeter in diameter and spaced about one millimeter apart, satisfactory results have been obtained by fabricating the support member 30 from tungsten wire 0.38 millimeter in diameter and forming the hook portion 33 in a manner such that its maximum width dimension is about 2.6 millimeters. The diameter of the primary coil turns in this case was approximately 1.6 millimeters.

The simple and unique shape of the wire support member 30 not only facilitates its manufacture but permits it to be readily assembled with the coiled filament 16 and then be properly positioned within the envelope 12 prior to and during the sealing-in operations. Such manufacturing advantages are inherent in the improved support 30 insofar as it can be easily slipped around the central part of the coiled-coil filament 16 so that the hook 33 engages one of the secondary turns and the stabilizing arcuate portion 34 is disposed in transversely protruding position relative to the filament coil. The resulting filament-support assembly, along with the connected lead-in conductor components, is then inserted into the tubular envelope 12 in such a manner that the arcuate loop 34 effects a slip-nesting type fit with the curved inner wall of the envelope and automatically seats the leg portion 32 against the inner wall of the envelope in alignment with the envelope and filament axes so that the end of the leg portion is in the seal area. After the filament 16 and its attached support wire 30 have been located at the proper position within the envelope 12, the ends of the envelope are heat-softened and formed into press seals 14, one of which encloses and thus firmly anchors the tip of the leg portion 32 of the wire support.

ALTERNATIVE EMBODIMENT (FIGS 4–5)

In certain types of tubular incandescent lamps having wattage and voltage ratings that necessitate the use of coiled-coil filaments that are very flexible or "flimsy", experience has shown that the mechanical interaction between the envelope wall and stabilizing loop portion of the improved support member of the present invention is not sufficient to reliably position the support member within the envelope during the sealing-in operation. It has been found that slight modification in the filament-support member solves this special manufacturing problem.

Figure 4:
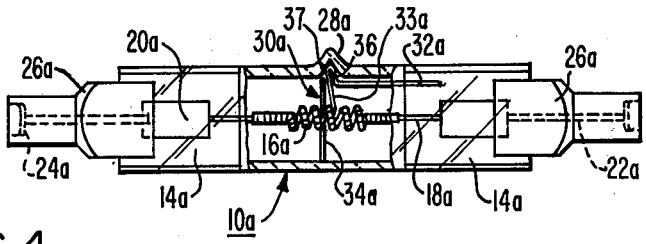
FIG. 4 is an elevational view of an alternative low-wattage lamp embodiment which employs a slightly modified support member.
Figure 5:
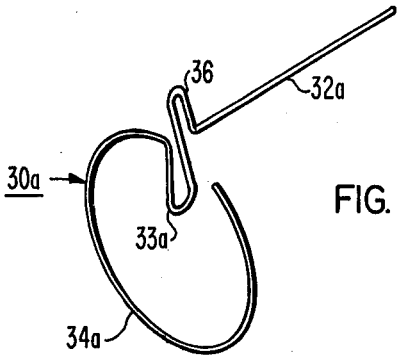
FIG. 5 is an enlarged pictorial view of the modified support member employed in the incandescent lamp shown in FIG. 4.

A low-wattage double-ended type incandescent lamp **10*a* having such a modified support member 30*a* is shown in FIG. 4 and the modified support component itself is shown in FIG. 5. The lamp 10*a* is constructed in the same manner as the previously described embodiment and thus has the same tubular envelope 12*a*, press seals 14*a*, coiled-coil filament 16*a*, etc. However, the filament 16*a*** is wound from tungsten wire of such diameter and at such a pitch, etc. that the resulting helical coil is long compared to its diameter and is thus not massive or rigid.

As a specific example, a low-wattage tubular lamp having a nominal rating of approximately 127 watts when operated at 36 volts and employing a T-4 type envelope (approximately 13 millimeters outside diameter and an overall length of slightly over 5 centimeters) has a coiled-coil filament that is wound from tungsten wire approximately 0.16 millimeter in diameter on a mandrel at a primary pitch such that the primary turns are 0.63 millimeter in diameter and spaced 0.115 millimeter apart, and on a secondary mandrel at a secondary pitch such that the secondary turns are 2.8 millimeters in diameter and spaced 0.49 millimeter apart. The overall length of the coil is approximately 30 millimeters and the coiled-coil barrel portion is 7.1 millimeters long and has six secondary turns.

The modified support member **30*a* employed in a low-wattage lamp of this type is shown in FIG. 5. It is formed from suitable wire (tungsten or molybdenum) in a manner such that the medial hook segment 33*a* is terminated by the stabilizing loop portion 34*a* (as in the previous embodiment) but is joined to the leg portion 32*a* by a finger-like extension 36** that laterally protrudes in a direction opposite the hook and is also defined by a U-shaped bent portion of the wire.

In the case of the 127 watt 36 volt T-4 incandescent lamp having the coiled-coil filament described above, satisfactory results were obtained by manufacturing the support member **30*a* from tungsten wire approximately 0.228 millimeter in diameter and forming the hook 33*a*** in a manner such that its maximum width dimension was 1.13 millimeters.

When the modified support member **30*a* is assembled with the coiled-coil filament 16*a* (that is, with the hook segment 33*a* slipped around and coupled to the centrally-located secondary turn) and the resulting assembly is inserted into the tubular envelope 12*a*, the upwardly protruding finger-like portion 36 slips into the exhaust tube (not shown) fused to the side wall of the envelope and effects a slip fit and mechanical interlock width the apertured portion of the envelope side wall. This automatically positions the leg portion 32*a* proximate the inner surface of the envelope 12*a* so that the tip of the leg portion is embedded and securely anchored in the press seal 14*a* that is subsequently formed at that end of the envelope. As shown in FIG. 4, the hook segment 33*a* is thus securely locked in the proper supporting relationship with the secondary turn of the coiled filament 16*a* in the finished lamp 10*a* by the fact that the arcuate terminal portion 34*a* is nestingly seated against the curved surface of the envelope 12*a* and the finger-like portion 36 is also nestingly seated within the cavity 37 formed by the tipped-off remnant 28*a* of the exhaust tube. The protruding finger-like portion 36 thus serves as an auxiliary positioning means for the support member 30*a*** during lamp manufacture.

As will be noted in FIG. 4, the U-shape and dimensions of the retroverted finger-like extension 36 of the modified support member **30*a* constitute important features of the present invention since they permit the support member to mechanically engage and become interlocked with the exhaust tube aperture of the envelope 12*a* without becoming embedded in or sealed to the fused tip of the exhaust tube remnant 28*a*. This simplifies the tipping-off operation and eliminates a potential leakage path into the sealed envelope 12*a* since the fused exhaust-tube tip 28*a* is not sealed or bonded to the metal support member 30*a*** in any manner whatsoever.

In order to ensure that the hook portions 33 and **33*a* of support members 30 and 30*a***, respectively, engage and are coupled to a secondary turn of the coiled-coil filament rather than a primary turn, the diameter of the wire from which the support members are fabricated is greater than the spacing between primary turns so that the hook portions bridge rather than slip between the primary turns which they contact.

While circular loop portions 34 and **34*a*** are shown in the drawings, non-circular loops can also be used providing they engage the arcuate surface of the tubular envelope at enough locations to lock the inserted support member in place. Triangular-shaped loops could thus be employed.

I claim as my invention:

1. In an electric incandescent lamp having an elongated tubular envelope that contains a helically-coiled filament which extends longitudinally within the envelope and is connected to lead-in conductors at least one of which passes through an hermetically sealed end of the envelope, the improvement comprising;

a filament-support member formed from wire and having (a) a leg portion that is anchored in the sealed end of the envelope and extends therefrom into the envelope proper proximate the wall thereof, (b) a retroverted medial segment that defines a hook which laterally protrudes from the leg portion and extends around and is thus coupled to a turn of the coiled filament, and (c) a stabilizing terminal portion that extends from said hook and is substantially disposed in a plane which is transverse to both the envelope axis and the coiled filament, said stabilizing terminal portion being of such configuration and size that it engages the arcuate inner surface of the tubular envelope at a sufficient number of locations along the envelope circumference that the support member is nestingly interlocked with the envelope and thus holds the coiled filament in suspended position within the envelope.

2. The incandescent lamp of claim 1 wherein said hook is coupled to a coil turn that is located inwardly from both ends of the filament and said wire member constitutes the sole support means for the medial portion of the coiled filament.

3. The incandescent lamp of claim 1 or 2 wherein the stabilizing terminal portion of said filament-support member comprises an arcuate loop that extends around the major portion of the envelope periphery.

4. The incandescent lamp of claim 1 wherein;

said lamp is of the double-ended type and has an hermetic seal formed on each end of the envelope, the ends of said coiled filament are connected to lead-in conductors that are embedded in and extend through the respective hermetic seals, and the leg portion of the filament-support member is anchored in one of said hermetic seals and extends in the same general direction as the coiled filament.

5. The double-ended incandescent lamp of claim 4 wherein;

said filament is of the coiled-coil type, and the hook of said filament-support member extends around and engages a single secondary turn of the coiled-coil filament.

6. The double-ended incandescent lamp of claim 5 wherein;

the portion of the tubular envelope which encloses closes the coiled-coil filament is of substantially circular cross-sectioon, said hook is generally U-shjaped and has a width dimension relative to the spacing-between-secondary turns of the coiled-coil filament that the hook is spaced from the secondary turns which are adjacent to the secondary turn that is coupled to said hook, and the stabilizing terminal portion of the filament support member comprises a single loop of substantially circular configuration that extends around the major portion of the envelope circumference.

7. The double-ended incandescent lamp of claim 5 wherein;

said tubular envelope has a laterally-protruding sealed remnant of an exhaust tube which defines a cavity in the side wall of the envelope that is located proximate the barrel portion of the coiled-coil filament, and said filament-support member has a finger-like extension that protrudes into the cavity in the envelope side wall and thus serves as an auxiliary positioning means for the support member during the fabrication of the lamp.

8. The double-ended incandescent lamp of claim 7 wherein;

said exhaust-tube remnant and cavity are centrally located relative to the ends of the coiled-coil filament;

said hook is generally U-shaped; and said finger-like extension is defined by a segment of the support wire that is also generally U-shaped and located at the free end of the leg portion of the support member immediately adjacent said hook.

9. The double-ended incandescent lamp of claim 6 wherein;

the leg portion of said support member is substantially straight and of such length that the hook engages a centrally-located secondary turn of the coiled-coil filament, and said support member constitutes the sole support means for the medial portion of the coiled-coil filament.

* * * * *